United States Patent [19]

Yackel, Jr.

[11] Patent Number: 4,739,995

[45] Date of Patent: Apr. 26, 1988

[54] TETHERED BALL TOY

[76] Inventor: Harold E. Yackel, Jr., 7286 Willow Brook Rd., Victor, N.Y. 14564

[21] Appl. No.: 78,974

[22] Filed: Jul. 29, 1987

[51] Int. Cl.[4] ..... A63B 67/10

[52] U.S. Cl. ..... 273/331; 273/371

[58] Field of Search ..... 273/331, 332, 333, 334, 273/335, 357, 371

[56] References Cited

U.S. PATENT DOCUMENTS

| | | | |
|---|---|---|---|
| 3,834,701 | 9/1974 | Hashimoto | 273/357 X |
| 3,930,649 | 1/1976 | Yackel, Jr. | 273/331 |
| 4,350,344 | 9/1982 | Bear | 273/333 |

FOREIGN PATENT DOCUMENTS

| | | | |
|---|---|---|---|
| 420403 | 9/1910 | France | 273/333 |
| 446182 | 4/1936 | United Kingdom | 273/334 |

*Primary Examiner*—William H. Grieb

*Attorney, Agent, or Firm*—Robert M. Phipps

[57] ABSTRACT

A cradle or tethered ball type toy is made more amusing and challenging by the use of a target housing instead of the conventional cradle to receive the ball. The target housing has an opening at the top to receive the ball but is then equipped with slits and return ball opening in the target to permit discharge of the ball from the target without separate action by the players. The housing also has electronic sensing device to separately record the balls from each support to which a ball is tethered.

3 Claims, 2 Drawing Sheets

TETHERED BALL TOY

BACKGROUND

1. Scope of the Invention

This invention relates to a toy and game using same, more particularly to a cradle or tethered ball toy.

2. Prior Art

U.S. Pat. No. 3,930,649 granted January 6, 1976 to Harold E. Yackel, Jr., discloses a device consisting of a base portion to which is secured upright frame portions having a cord or string secured to the upper extremity of the cord having a weighted ball on the opposite end which is to be placed into a center mounted ball support.

The toy disclosed by Yackel above requires a certain level of skill to position the ball on the central cradle. However, in terms of the current cultural background this toy fails to provide the desired level of excitement and imagination.

It is therefore an object of this invention to provide a toy and game requiring a higher level of skill than previously required. It is another object of this invention to provide a toy and game which provides a higher level of contemporary enjoyment, e.g. aesthetics, excitement, over that of prior toys. Still other objects will be apparent to those skilled in the art upon reference to the following detailed description.

SUMMARY OF THE INVENTION

In accordance with this invention there is provided in a cradle or tethered ball type toy having a flat base, a plurality of spaced apart supports secured upon said base, and to each of said ball supports one end of a flexible line is attached and at the other end of said line is attached a ball, the improvement comprising;

a target housing secured upon and in the center of said base, said ball supports being spaced equidistant from and on two sides of said target housing, said target housing having a top and sides, said top having at its center a top opening sized to receive one of said balls at any one time, said top having a top slit for passing through it said flexible line, said top slit extending from one side of said housing through said top opening to the other side of said housing, said slit being aligned in the direction of said ball supports, a side opening sized to receive said ball from said top opening on each side of said target housing nearest said ball supports, said side openings being located beneath said top slit, a side slit on each side extending from said side openings to said top slit whereby said ball attached to said flexible line when passed through said top opening may continue in motion through said target housing and escape at said side opening nearest said ball support to which said ball and flexible line is attached, said target housing having electronic sensing means for determining when a ball has passed through said target housing and the ball support to which said ball is attached, said sensing means actuating one or more score boards for recording the number of times said ball has passed through said target housing, whereby said ball is automatically removed from said target and an accurate score of the game is obtained when the toy is played with.

DESCRIPTION OF THE PREFERRED EMBODIMENT

Figure 1:
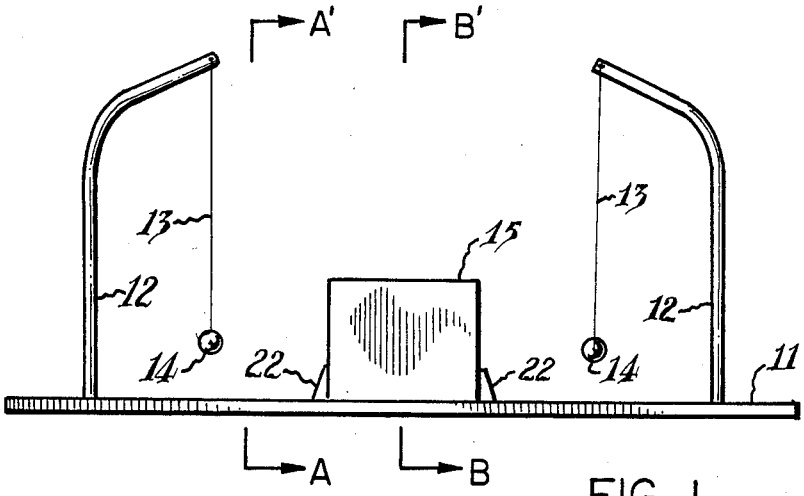
FIG. 1 is a side view of the toy of this invention.

The tethered toy 10 of this invention, as shown in FIG. 1, offers the player or players dexterity skill challenges and excitement in today's culture. The toy 10 has a base component 11, while shown in FIG. 2 as rectangular, can be of other shapes as desired, e.g. oval. Affixed to the base 11 are two or more ball supports 12. These supports 12 are permanently secured to the base 11, however, the supports 12 can be attached to swivel to the right or left if so desired. The supports 12 are so positioned on the base 11 that an equal number are on each of two sides of the target housing 15. The supports 12 are equal distance from the housing 15.

To each support 12 is attached a flexible line 13. One end of line 13 is attached to the support 12 and the other end of the line 13 is attached to a ball 14. The line 13 can be made from string, monofilement synthetic fiber or rubber thread as desired. Each line 13 is of substantially the same length and that is the distance from the support 12 to the target 16. Preferably the balls 14 descend almost to the surface of the base 11. Each ball 13 is substantially made of the same material and size. The ball 14 is made of glass, hard rubber, plastic or other suitable material as desired.

Figure 2:
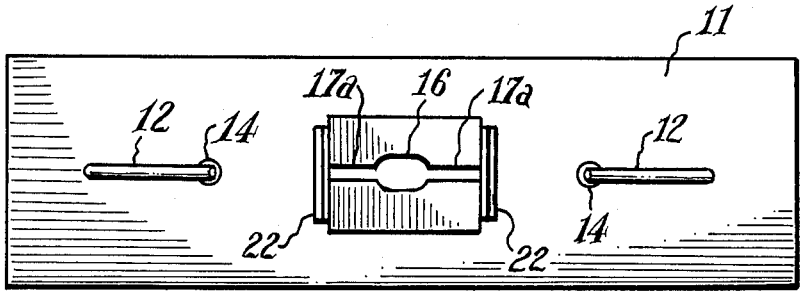
FIG. 2 is a top plan view of the toy of FIG. 1

The target housing 15 is centered on and attached to base 11. As shown in FIG. 2 the top of the target housing 15 has a target or ball receiver 16 to catch the ball 14. The ball receiver 16 is so sized that only one ball 14 can passed through the receiver 16 at any time. The ball 14 then passes through the housing 15 to the ball return or side opening 18 on the same side of the housing 15 as the support 12 to which the ball 14 is attached. To facilitate the passage of line 13 through the housing 15 a string return slit 17 is provided in the housing top 17*a* and housing side 17*b*. To assist the ball's 14 passage through the housing 15 when the housing is of a larger size, a ball guide, such as slit tube or wire guides, extending from target 16 to ball return 18 can be provided. In larger models this will facilitate a swift return of the ball 14. The structure of the target housing 15 is such that the ball 14 is returned to playing position without intervention and action by the player.

Figure 3:
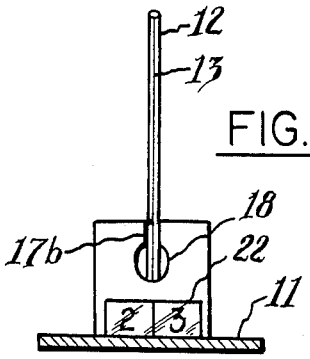
FIG. 3 is a cross-section end view of the toy of FIG. 1 taken along line A–A'.
Figure 4:
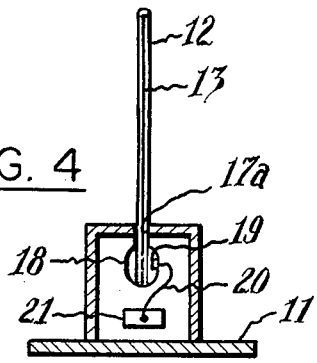
FIG. 4 is a cross-section end view of the toy of FIG. 1 taken along line B–B'.

At a convenient place within the target housing 15 as shown in FIG. 4 a ball sensor 19 associated with each ball return 18 is provided. The sensor 19 may be mounted at the ball return 18 or if the housing 15 is equipped with ball guides, then on the ball guide as desired. The ball sensor 19 is connected via electrical conduit 20 to an electronic unit 21 equipped with appropriate micro chips. On each side of the target housing 15 facing the ball supports 12 and below the ball returns 18 as shown in FIG. 3 is a score board 22 which records the number of balls 14 from each support 12 passed through the target housing 15. The score boards 22 are connected by conduit (not shown) to and controlled by the electronic unit 21. The electronic unit 21 is powered by battery or connected to a live source of electricity as desired. The score boards 22 can be reset to zero as desired.

Toy 10 is used by the player picking up ball 14 and with a swinging action letting the ball 14 drop in direction of the ball receiver (target) 16. All the players can at the same time attempt to throw their ball 14 into the target 16 and block the other balls 14 from passing through the target 16. The game continues until one player reaches the score previously agreed upon as required to win the game. Conditions of play can be varied by the rotation of ball supports 12 to either the right or left of each player.

Figure 5:
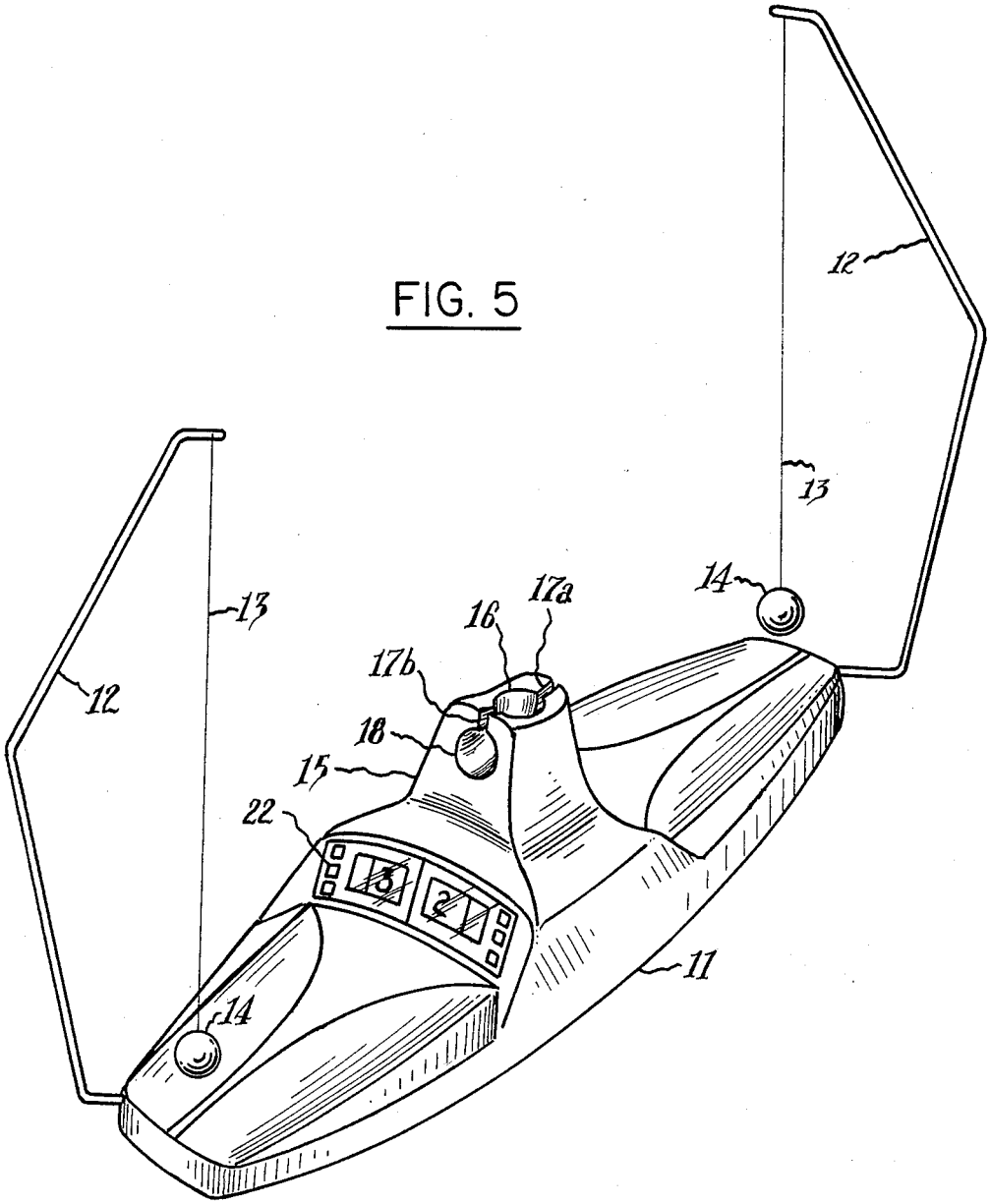
FIG. 5 is a side perspective view of the toy of this invention modified to look like a speed boat.

While not essential to the toy 10, target housing 15 can be shaped as a simple object, e.g. box or cylinder, or it can be made and colored in a fanciful manner, e.g. mountain volcano, ship, speed boat or the like wherein the base 11 and target housing 15 are combined into an unitary structure as shown in FIG. 5.

Ball supports 12 have been shown as upright posts with arms, however, other forms of support may be used provided they permit passage of the flexible line 13 through the target housing.

The foregoing examples and methods have been described in the foregoing specification for the purpose of illustration and not limitation. Many modifications and ramifications will naturally suggest themselves to those skilled in the art based on this disclosure. These are intended to be comprehended as within the scope of this invention.

The embodiments of the invention in which as exclusive property or privilege is claimed are defined as follows:

1. In a cradle or tethered ball type toy having a flat base, a plurality of spaced apart supports secured upon said base, and to each of said supports one end of a flexible line is attached and at the other end of said line is attached a ball, the improvement comprising;

a target housing secured upon and in the center of said base, said ball supports being spaced equidistant from and on two sides of said target housing, said target housing having a top and sides, said top having at its center a top opening sized to receive only one of said balls at any one time, said top having a top slit for passing through it said flexible line, said top slit extending from one side of said housing through said top opening to the other side of said housing, said slit being aligned in the direction of said ball supports, a side opening sized to receive said ball from said top opening on each side of said target housing nearest said ball supports, said side openings being located beneath said top slit, a side slit on each side extending from said side openings to said top slit whereby said ball attached to said flexible line when passed through said top opening may continue in motion through said target housing and escape at said side opening nearest said ball support to which said ball and flexible line is attached, said target housing having electronic sensing means for determining when a ball has passed through said target housing and the ball support to which said ball is attached, said sensing means actuating one or more score boards for recording the number of times said ball has passed through said target housing, whereby said ball is automatically removed from the said target and an accurate score of the game is obtained when the toy is played with.

2. The toy of claim 1 wherein there are two ball supports.

3. The toy of claim 2 wherein said base and target housing are combined into an unitary part.

* * * * *